United States Patent [19]

Salzberg

[11] 4,302,733

[45] Nov. 24, 1981

[54] MICROWAVE HYBRID COUPLERS

[76] Inventor: Edward Salzberg, 19 Black Oak Rd., Wayland, Mass. 01778

[21] Appl. No.: 124,619

[22] Filed: Feb. 25, 1980

[51] Int. Cl.[3] ..... H01P 1/15; H01P 5/20

[52] U.S. Cl. ..... 333/101; 333/103; 333/122

[58] Field of Search ..... 333/117, 118, 121, 122, 333/101, 103

[56] References Cited

U.S. PATENT DOCUMENTS

| | | | |
|---|---|---|---|
| 2,619,635 | 11/1952 | Chait | 333/122 X |
| 2,801,391 | 7/1957 | Whitehead | 333/122 |
| 2,884,600 | 4/1959 | Fox | 333/117 X |
| 2,938,084 | 5/1960 | Autrey | 333/117 X |

*Primary Examiner*—Paul L. Gensler
*Attorney, Agent, or Firm*—Thomas N. Tarrant

[57] ABSTRACT

Microwave hybrid coupler combinations using magic tees in which the symmetrical arms are used for output ports in power combining and the nonsymmetrical arms are used for output ports in power dividing.

13 Claims, 7 Drawing Figures

MICROWAVE HYBRID COUPLERS

BACKGROUND OF THE INVENTION

1. Field of the Invention

Present invention relates to microwave hybrid tee junctions connected in combination and particularly to such combinations in which the symmetrical arms are used for output connections in power combining and nonsymmetrical arms are used for output connecting in power dividing.

2. Description of the Prior Art

Magic tees, because of their plane of symmetry, are usually used as power dividers with the e or h ports as the input and the symmetrical ports as the two outputs. This is the most natural way to use the tees since the output phase relationships are a clear 0 or 180 degrees, and the output equality is essentially perfect. The tees are also often used as power combiners in which case the preferred choice for the two inputs is the symmetrical ports since the input phase and split requirements are clearly defined and easily realized. Previous U.S. Pat. No. 3,931,599 of the present inventor describes hybrid tee junction combinations with the e and h plane arms providing input, output functions. It has been considered undesirable to use a magic tee as a power divider with the e and h ports as outputs since it is difficult to obtain equal split in the output and the output phase may track at some odd angle. It is also uncommon to use the symmetrical ports as outputs for a power combiner because of an apparent difficulty in meeting the required input phases and amplitude requirements to get precise power combination.

Technical Bulletin No. 020774-1 of Electromagnetes Sciences Inc., Chamblee, Ga., describes a power modulator in which a magic tee is used as a power divider and the power out is connected through the symmetrical arms to two phase shifters which drive a quadrature coupler. If one of the phase shifters is switched 180°, the output will change terminals and shift 90° in phase. The outputs of the quadrature coupler will always be 180° out of phase with each other.

SUMMARY OF THE INVENTION

In accordance with the present invention it has been found that magic tees can be connected as power combiners with their symmetrical arms as the outputs and can be connected as power dividers with their nonsymmetrical arms as the outputs without losing the quality of the magic tees as usually used. Thus it is an object of the invention to provide combinations of magic tee hybrid couplers connected as power divider/combiners in the reverse configuration. Further objects and features of the invention will become apparent upon reading the following description together with the drawing.

DESCRIPTION OF THE PREFERRED EMBODIMENT

Figure 1:
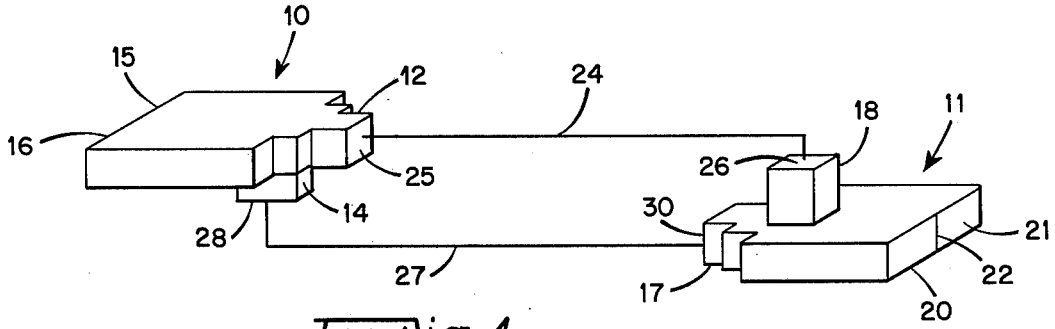
FIG. 1 is a drawing in perspective of two magic tees joined in accordance with the invention.

FIG. 1 is an embodiment of the invention using two h-plane folded magic tees 10 and 11. Tee junction 10 has h arm 12 and e arm 14 as nonsymmetrical arms. Symmetrical arms 15 and 16 are folded in the h plane with a common dividing wall (not shown) separating them. Similarly, tee junction 11 has an h arm 17 and e arm 18 as nonsymmetrical arms and arms 20 and 21 separated by common wall 22 as symmetrical arms. In the magic tee junction, the symmetrical arms are colinear, however, in many applications today the symmetrical arms are folded in the e plane or in the h plane. In FIG. 1 the symmetrical arms are shown folded in the h plane. The configuration of the symmetrical arms is not significant to the invention and they may be folded at either plane or not folded at all. It is critical to simplicity of design in the present invention that the junctions used in combination be as nearly alike as possible.

Connection 24 connects port 25 of h arm 12 to port 26 of e arm 18. Connection 27, identical to connection 24, connects port 28 of e arm 14 to port 30 of h arm 17. Thus all of the nonsymmetrical arms are interconnected leaving only the symmetrical arms available for input, output connections. Connections 24 and 27 are preferable substantially identical wave guide connections. It will be noted that while each of junctions 10 and 11 lacks symmetry at two of its ports, the combination of the two junctions as connected in FIG. 1 considered as a single junction is completely symmetrical with respect to all four available ports.

Figure 2:
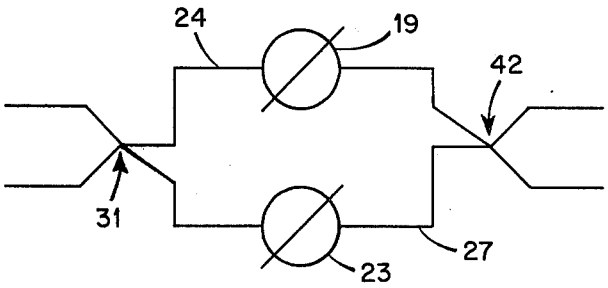
FIG. 2 is a schematic diagram showing a second embodiment of the invention in which 2 magic tees are coupled together by two phase shifters.

In FIG. 1 with an input at one of arms 15 and 16, magic tee 10 is acting as a power divider having its output at the nonsymmetrical arms e arm 14 and h arm 12. By connecting these outputs to the nonsymmetrical arms of magic tee 11, magic tee 11 acts as a power combiner providing its output at one of the symmetric arms 20 and 21. This entire configuration is symmetric as a combination so that placing identical things into connecting lines 24 and 27 will not affect the symmetry. For a given input at arms 15 and 16, the output at arms 20 and 21 can be changed, such as switching from one port to the other, by phase shifters in lines 24 and 27. Thus FIG. 2 shows a magic tee 42 in the place of magic tee 11 of FIG. 1. Phase shifter 19 is located in connecting line 24 and phase shifter 23 is located in connecting line 27.

Figure 3:
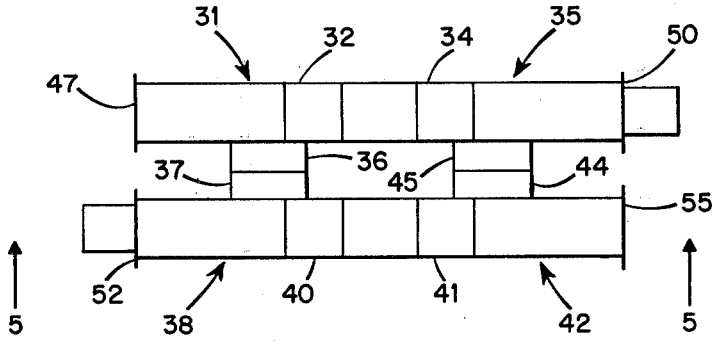
FIG. 3 is a front elevation of four magic tees interconnected in an embodiment according to FIG. 2 using magic tees coupled to phase shifting devices as phase shifters.
Figure 4:
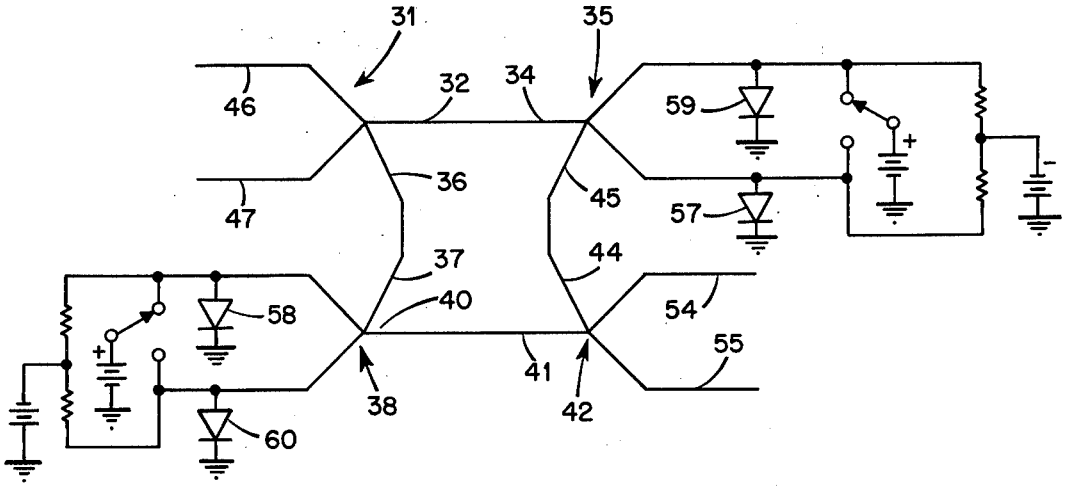
FIG. 4 is a schematic diagram of the embodiment of FIG. 3.

While many alternatives are available for phase shifters 19 and 23, one arrangement that works out well is depicted schematically in FIG. 4 in which phase shifters 19 and 23 are depicted as magic tees 35 and 38 respectively each with diode phase shifting devices. Thus the entire combination can be put together with 4 identical magic tees which are depicted in FIG. 3 as waveguide magic tees all using the folded h plane configuration of magic tees 10 and 11 (FIG. 1).

Using four magic tees, the e arms are connected to e arms and the h arms are connected to h arms while still retaining complete symmetry. Tee junction 31 has its h arm 32 connected to h arm 34 of tee junction 35. E arm 36 of junction 31 is connected to e arm 37 of junction 38. H arm 40 of junction 38 is connected to h arm 41 of junction 42. E arm 44 of junction 42 is connected to e arm 45 of junction 35. Thus again all nonsymmetrical arms are interconnected with each other. The configuration of FIG. 3 as can be seen in the illustration, lends itself readily to direct coupling of the nonsymmetrical arms. Minimal interconnecting adaptation is needed and a very compact configuration can be produced.

The symmetrical arms of junction 31 terminate in ports 46 and 47 (FIGS. 3 and 4). The symmetrical arms of junction 35 terminate in diode switches 57 and 59. The symmetrical arms of junction 38 terminate in diode switches 58 and 60 and the symmetrical arms of junction 42 terminate in ports 54 and 55. Thus eight ports are available for connection purposes. Diode switches 57, 58, 59 and 60 are impedance switching devices and operate tees 35 and 38 as phase shifters.

FIG. 4 schematically depicts diode switching devices connected to these ports, this leaves ports 46, 47, 54 and 55 available for input, output connections. A truth table for the embodiment of FIGS. 3 and 4 is provided in table 1 to illustrate the functions available from this type of device.

In table I, "Feed" indicates the input port of tee junction 31, port 46 or 47 to which an input signal is fed. "Bias" indicates whether the diodes indicated are forward or reversed biased, + indicating forward and − indicating reverse. "Power output" indicates which of symmetrical arms 54 and 55 provides the output power, and "Relative Phase" is the comparison of phase at the feed as compared with the power output terminal.

TABLE I

| | BIAS | | | | POWER | RELATIVE |
|---|---|---|---|---|---|---|
| FEED | 59 | 57 | 58 | 60 | OUT | PHASE |
| 46 | − | + | + | − | 55 | 0 |
| 46 | + | − | − | + | 55 | 180 |
| 46 | + | − | + | − | 54 | 0 |
| 46 | − | + | − | + | 54 | 180 |
| 47 | − | + | + | − | 54 | 0 |
| 47 | + | − | − | + | 54 | 180 |
| 47 | + | − | + | − | 55 | 0 |
| 47 | − | + | − | + | 55 | 180 |

Figure 5:
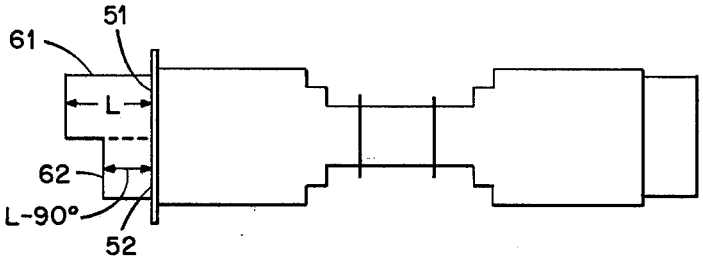
FIG. 5 is a bottom view along 5—5 of FIG. 3 with two shorted waveguide stubs operating as a tracking line, replacing one diode assembly in a third embodiment.
Figure 6:
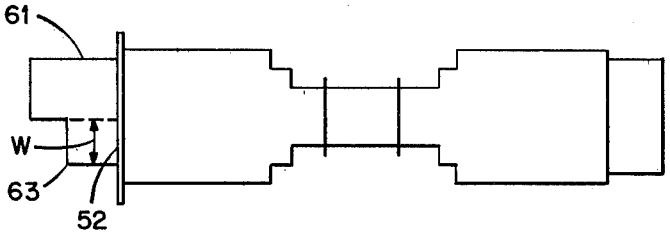
FIG. 6 is a modification of FIG. 5 in which one of the shorted stubs is a different width.
Figure 7:
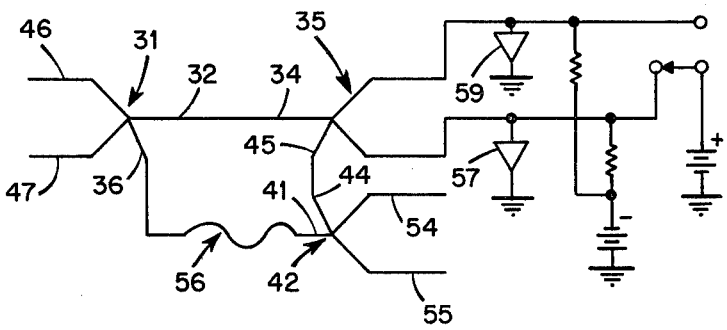
FIG. 7 is a schematic diagram of an embodiment in which one of the phase shifters has been replaced with a tracking line.

FIGS. 5, 6 and 7 depict alternative arrangements in which only one controllable phase shifter is used. FIG. 5 depicts one such arrangement as it would be in a bottom plan view of FIG. 3. In this case ports 51 and 52 are coupled to shorted wave guide sections instead of to diode switches. Connected to port 51 is a shorted piece of wave guide 61 having length L. Connected to port 52 is a shorted length of wave guide 62 having electrical length L-90°. The length L-90° is a length that is electrically 90° shorter at the design frequency than the length L. FIG. 6 depicts a similar arrangement, but with a shorted wave guide 63 connected to port 52 somewhat narrower in the dimension W across its wide wall than shorted wave guide 61. This variation provides less frequency sensitivity over a broader frequency band than that of FIG. 5.

Truth table I still applies, but only that part of it that assumes no changes in biasing for diodes 58 and 60. Table I as used will depend on the length of the respective shorted wave guides. So that by way of example, terminal 51 can be considered as having the fixed condition of a forward biased diode 58. Terminal 52 can be considered as having the fixed condition of a reversed bias diode 60.

FIG. 7 operates in exactly the same way as FIGS. 5 and 6 except that magic tee 38 is replaced with a tracking line 56. The magic tees coupled to shorted waveguide stubs in FIGS. 5 and 6 are tracking lines. Tracking line 56 can also be a length of wave guide selected to have as near as possible electrical symmetry with tee junction 35. Since tracking line 56 can be mechanically dissimilar, electrical symmetry is harder to obtain as a matter of design but close approximations can be reached. There are sometimes advantages in this type of arrangement, at least for packaging purposes.

Referring back to FIG. 2, phase shifters 19 and 23 may be continuously variable ferrite phase shifters or other known phase shifters useful in the microwave band. Ferrite or other phase shifting devices may also be coupled to magic tees 35 and 38 instead of semiconductor diode devices. The magic tees can be planar tees as well as waveguide tees and coaxial configurations are also contemplated. Input tee 31 in FIG. 2 can be replaced with other input devices and the configuration of two phase control devices driving the nonsymmetrical arms of a magic tee provides a power output in the symmetrical arms that shifts 0° or 180° in phase and switches from one port to the other when one of the input phase control devices is shifted 180°.

It is significant that when using four magic tees as in FIGS. 3 and 4, an input at any one of ports 46, 47, 54 and 55 will combine in one of the ports of the opposite tee with the other port of the opposite tee remaining perfectly isolated. This is true over the entire transmission band of the magic tee no matter how poorly designed the tees are providing their construction is identical. For this purpose it is critical that tees 31 and 42 be identical, but not necessarily identical to tees 35 and 38. It is desirable that tees 35 and 38 also be identical to each other.

While the invention has been described with respect to specific embodiments, variations within the skill of the art are contemplated and it is intended to cover the invention as set forth within the scope of the following claims.

I claim:

1. A microwave hybrid tee transfer switch using magic tee hybrid couplers comprising:

(a) a first hybrid tee having two symmetrical arms terminating in first and second output ports, an E-plane arm and an H-plane arm;

(b) a second hybrid tee having two symmetrical arms terminating in first and second input ports, an E-plane arm and an H-plane arm;

(c) a variable phase shifter connected between the E-plane arm of one of said first hybrid tee and said second hybrid tee and the H-plane arm of the other; and (d) a phase shifting device connected between the H-plane arm of said one and the E-plane arm of said other, whereby microwave power fed to one of said input ports can be fed to one of said output ports and switched between said output ports by varying said variable phase shifter.

2. A microwave hybrid tee transfer switch according to claim 1 wherein at least one of said first phase shifter and said second phase shifter selectively shifts phase at the design frequency in the fixed amount of 180° whereby output power can be switched between said first and second output ports.

3. A microwave hybrid tee transfer switch according to claim 1 wherein at least one of said first phase shifter and said second phase shifter is continuously variable whereby signals at said first input terminal and said second input terminal can be selectively divided between said first and second output ports.

4. A microwave hybrid tee transfer switch according to claim 1 wherein said first hybrid tee and said second hybrid tee are substantially identical, said first phase shifter and said second phase shifter are substantially identical and connecting lines are balanced so as to provide symmetry.

5. A microwave hybrid tee transfer switch according to claim 1 wherein said first phase shifter and said second phase shifter comprise hybrid tees.

6. A microwave hybrid tee power divider/combiner combination comprising:

(a) a first hybrid tee having two symmetrical arms terminating in first and second input ports, an E-plane arm and an H-plane arm terminating in first and second output ports respectively;

(b) a second hybrid tee having two symmetrical arms terminating in second and third output ports, an E-plane arm and an H-plane arm terminating in third and fourth input ports respectively;

(c) a controllable phase shifter connected between the E-plane arm of one of said first hybrid tee and said second hybrid tee and the H-plane arm of the other; and, (d) a fixed phase shift connection between the remaining E-plane arm and the remaining H-plane arm, said connection having similar response characteristics to said phase shifter over the design frequency band.

7. A microwave hybrid tee power divider/combiner according to claim 6 wherein said fixed phase shift connection is a tracking line.

8. A microwave hybrid tee power divider/combiner combination according to claim 6 wherein said first hybrid tee, said second hybrid tee and said phase shifter all comprise substantially identical hybrid tee devices.

9. A microwave hybrid tee power divider/combiner combination according to claim 8 wherein said fixed phase shift connection is a fourth hybrid tee having first and second symmetrical arms terminated with first and second lengths of shorted wave guide.

10. A microwave hybrid tee power divider/combiner combination according to claim 9 wherein said first length of shorted wave guide is electrically 90° longer at the center design frequency than said second length of shorted waveguide.

11. A microwave hybrid tee power divider/combiner combination according to claim 10 wherein the width of one of said first and second lengths of shorted waveguide is substantially less than the width of the other.

12. A combinatino of microwave hybrid junctions comprising:

(a) first, second, third and fourth substantially identical hybrid junctions each having two symmetrical arms and two nonsymmetrical arms, the nonsymmetrical arms of each junction consisting of one E-plane and one H-plane arm;

(b) a plurality of connections coupling the E-plane arm of said first junction directly to the E-plane arm of said second junction, the H-plane arm of said first junction to the H-plane arm of said third junction, the E-plane arm of said third junction directly to the E-plane arm of said fourth junction and the H-plane arm of said fourth junction directly to the H-plane arm of said second junction; and, (c) a switchable phase shift device terminating each of the symmetrical arms of said second junction and said third junction.

13. A combination of microwave hybrid junctions according to claim 12 wherein each said switchable device is a semiconductor diode and further comprising biasing supplies for selectively biasing said diodes into low or high impedances conditions to effectively change the reflection point of energy at the design frequency in the respective arm.

* * * * *